US008661589B2

(12) United States Patent
Schambon

(10) Patent No.: US 8,661,589 B2
(45) Date of Patent: Mar. 4, 2014

(54) PORTABLE DIAPER CHANGING DEVICE

(76) Inventor: Amanda N. Schambon, Blue Bell, PA (US)

( * ) Notice: Subject to any disclaimer, the term of this patent is extended or adjusted under 35 U.S.C. 154(b) by 169 days.

(21) Appl. No.: 13/410,371

(22) Filed: Mar. 2, 2012

(65) Prior Publication Data

US 2013/0227792 A1 Sep. 5, 2013

(51) Int. Cl.
*A47D 13/00* (2006.01)
*A47D 15/00* (2006.01)

(52) U.S. Cl.
USPC ..... 5/655

(58) Field of Classification Search
USPC ..... 5/630, 648, 655, 947; 297/4, 195.11; 220/17.1; 108/43; 128/845, 869; 248/444
See application file for complete search history.

(56) References Cited

U.S. PATENT DOCUMENTS

| | | | | |
|---|---|---|---|---|
| 4,903,932 | A * | 2/1990 | Stewart, Jr. | 248/444 |
| 4,935,973 | A * | 6/1990 | Behrman | 5/2.1 |
| 5,937,765 | A * | 8/1999 | Stirling | 108/43 |
| 6,928,680 | B1 * | 8/2005 | Cai et al. | 5/655 |
| 7,065,814 | B2 * | 6/2006 | Rutkowski | 5/655 |
| 7,467,433 | B2 * | 12/2008 | Wong | 5/655 |
| 2002/0145019 | A1 * | 10/2002 | Ulibarri | 224/267 |
| 2004/0211003 | A1 * | 10/2004 | Stackman et al. | 5/655 |
| 2009/0271928 | A1 * | 11/2009 | Tishby | 5/655 |

* cited by examiner

*Primary Examiner* — Michael Trettel
(74) *Attorney, Agent, or Firm* — Stuart M. Goldstein

(57) ABSTRACT

A diaper changing device utilizes a baby supporting member having a supporting surface on which a diaper is to be positioned, naps extend outward from the supporting member and are configured to be foldable over the diaper placed on the supporting surface to maintain the diaper in position on the device. Straps are provided to circumscribe the leg of the user, i.e. the diaper changer, and to maintain the device on the changer's leg. Once the device is secured on the user's leg, the baby is placed on the diaper. The diaper is then wrapped around the baby and secured, all while the baby is positioned upon the device.

20 Claims, 3 Drawing Sheets

PORTABLE DIAPER CHANGING DEVICE

BACKGROUND OF THE INVENTION

Parents with diaper wearing babies have long faced the challenge of changing their children's diapers in locations in which a changing table or readily accessible, elevated surface is not available. Such challenges especially arise when parents with children are traveling or are away from home at a public place such as a shopping mall, restaurant, office, etc. These situations are commonly addressed by the use of various portable child support pads and cushions. However, such products rely on the presence of a suitable surface on which they and the child must be placed. Often times this surface is the ground or floor, certainly not the most sanitary location and one which also results in physical discomfort for the squatting or kneeling diaper changer herself or himself. In addition, most of these pad and cushion diaper changing products do not have adequate means to secure a squirming baby while a diaper is being applied. Further, while such products are designed to be folded, rolled, or otherwise reduced in size for transport, many are still bulky and do not easily fit into diaper bags or carrying cases.

SUMMARY OF THE INVENTION

It is thus the object of the present invention to provide a diaper changing device which overcomes the disadvantages and limitations of prior such devices.

It is the object of the present invention to provide a diaper changing device which comprises an integral, unitary, lightweight baby supporting member with diaper attached flaps, which is readily compacted for easy storage and portability.

It is a further object of the present invention to provide a diaper changing device which is quickly and easily secured to the leg of the diaper changing user, allowing the baby to be placed on the device on the user's leg while the baby's diaper is being changed.

It is another object of the present invention to provide a diaper changing device which can be utilized in virtually any location where there is seating available for the diaper changer.

These and other objects are accomplished by the present invention, a diaper changing device comprising a baby supporting member having a supporting surface on which a diaper is to be positioned. Flaps extend outward from the supporting member and are configured to be foldable over the diaper placed on the supporting surface to maintain the diaper in position on the device. Straps are provided to circumscribe the leg of the user, i.e. the diaper changer, and to maintain the device on the changer's leg. Once the device is secured on the user's leg, the baby is placed on the diaper. The diaper is then wrapped around the baby and secured, all while the baby is positioned upon the device.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
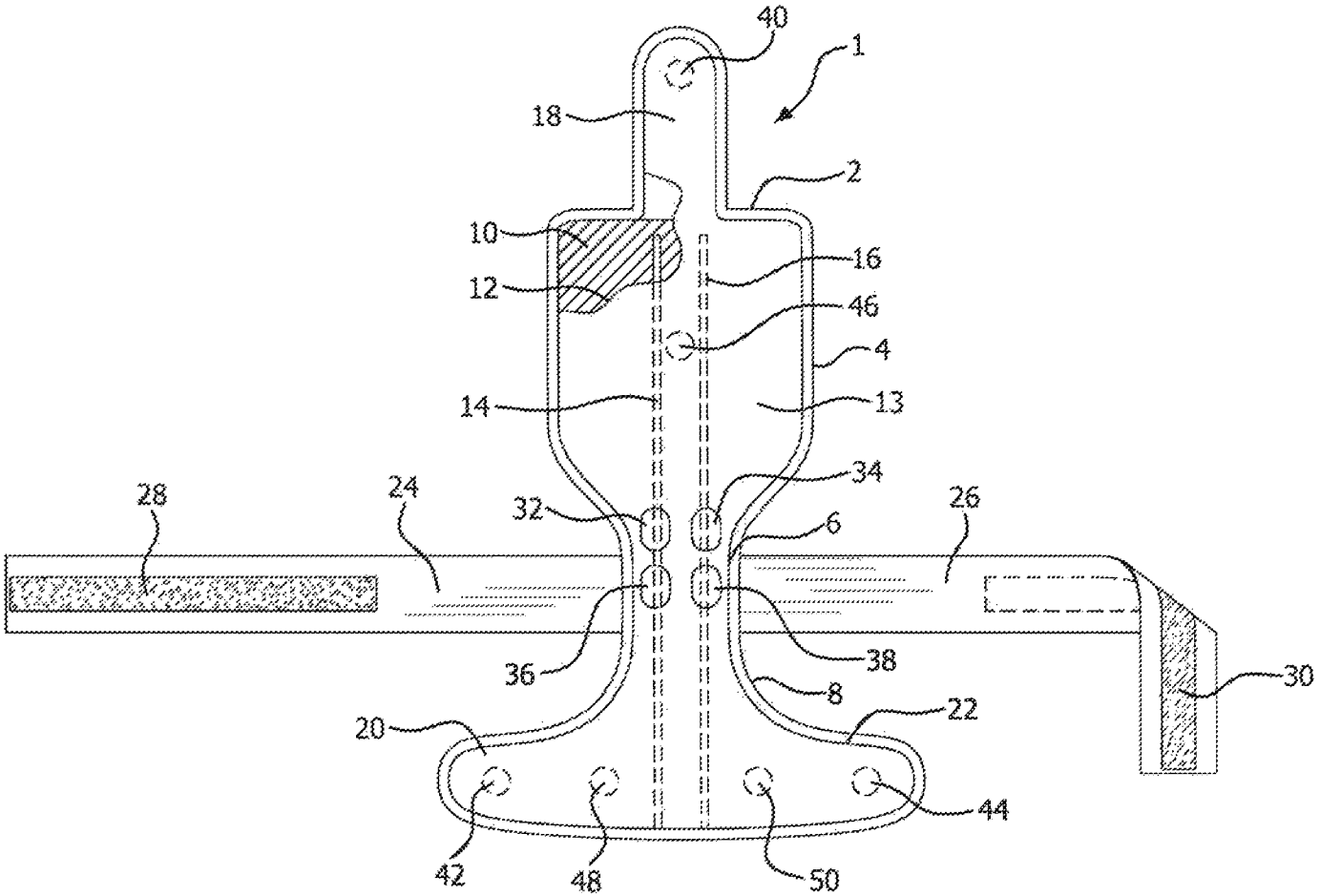
FIG. 1 is a top side plan view, partially broken away, of the portable diaper changing device of the present invention.
Figure 2:
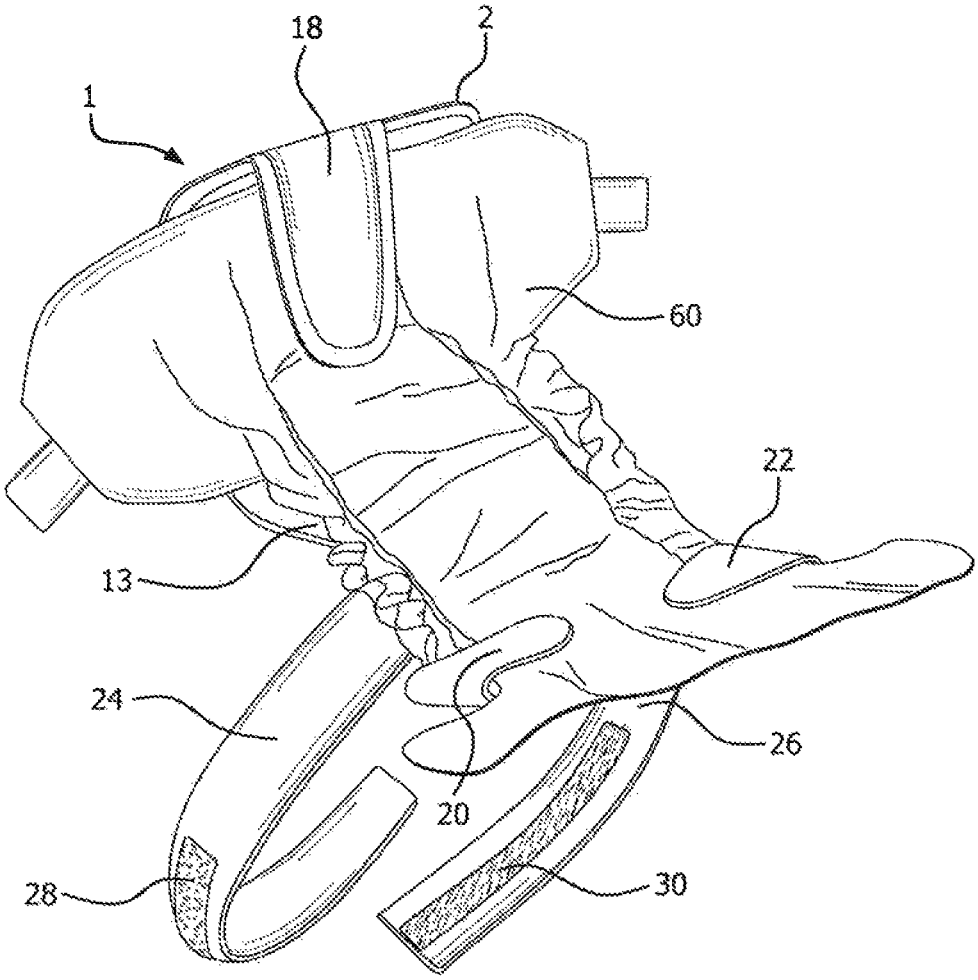
FIG. 2 is an isometric view of the portable diaper changing device of the present invention with a diaper positioned therein.
Figure 3:
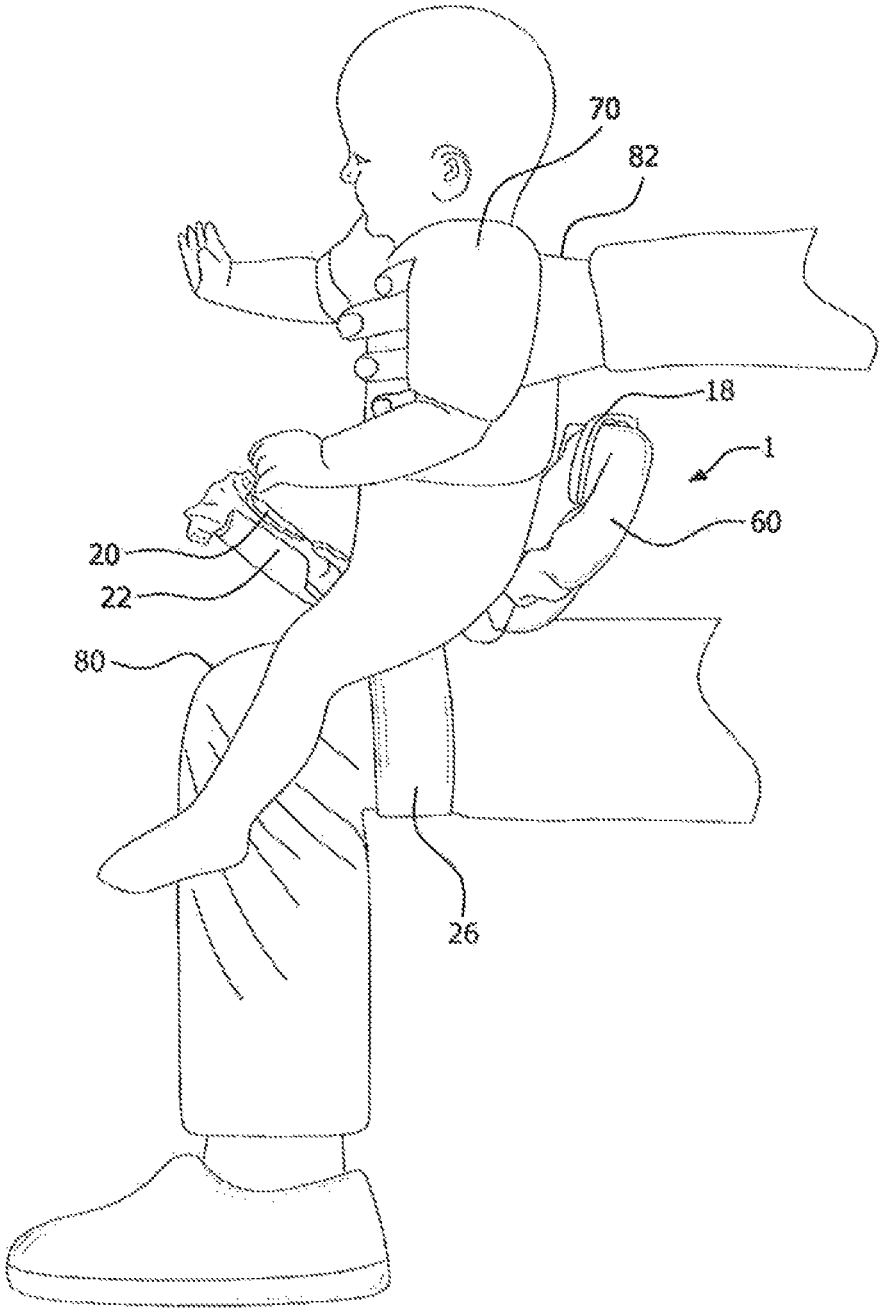
FIG. 3 shows the manner of use of the portable diaper changing device of the present invention.

Portable diaper changing device 1 of the present invention comprises baby supporting member 2 having rear section 4, intermediate section 6, and forward section 8. FIG. 1 is a view of the device, fully laid out, showing its top side. Baby supporting member 2 is a unitary, integral member comprising a lightweight, easily bendable core 10, e.g. plastic, aluminum, or equivalent, which is totally enclosed, both top side and back side, within a durable, lightweight, waterproof, flexible material 12. The top side surface of material 12 is the diaper supporting surface 13 of baby supporting member 2. Flexible, lightweight, bendable metal rods 14 and 16 are positioned and secured between core 10 and material 12 of baby supporting member 2, as seen in FIG. 1. Rods 14 and 16 extend almost the full length of the baby supporting member. This construction of baby supporting member 2 permits its rear section 4, intermediate section 6, and forward section 8 to be bendably adjusted to conform with the child whose diaper is to be changed. Bended configurations of diaper changing device 1 are depicted in FIGS. 2 and 3.

Rear flap 18 and forward flaps 20 and 22 extend from baby supporting member 2. Straps 24 and 26 extend outwardly from intermediate section 6 of baby supporting member 2 and Velcro® connections 28 and 30 are secured to straps 24 and 26 respectively.

Velcro® or equivalent connection pieces 32, 34, 36, and 38 are located on diaper supporting surface 13 of baby supporting member 2. Magnets 46, 48, and 50 are positioned and secured between core 10 and material 12 of baby supporting member 2. Magnet 40 is positioned and secured within flap 18, between the top side and back side of material 12. Magnets 42 and 44 are positioned and secured within flaps 20 and 22, respectively, between the top side and back side of material 12.

In use, rear section 4, intermediate section 6 and forward section 8 of baby supporting member 2 are bent and configured to accept the baby whose diaper must be changed. As best seen in FIG. 2, diaper 60 is then appropriately positioned on diaper supported surface 13 of baby supporting member 2. Velcro® pieces 32, 34, 36, and 38 adhere to diaper 60, thus providing the first means to attach the diaper to diaper changing device 1. Diaper 60 is then securely maintained on baby supporting member 2 by means of flaps 18, 20, and 22, which are folded such that they overlay the diaper. When the flaps are folded onto diaper 60, magnet 40 in flap 18 is attracted to magnet 46 in rear section 4, magnet 42 in flap 20 is attracted to magnet 48 in forward section 8, and magnet 44 in flap 22 is attracted to magnet 50 in the forward section. Despite the fact that diaper 60 is located between magnets 40 and 46, 42 and 48, and 44 and 50, it is contemplated that the magnets will have sufficient magnetic attractive force to securely maintain the diaper between flaps 18, 20, and 22 and the diaper supporting surface 13.

Diaper changing device 1, with diaper 60 secured in position, is next placed on leg 80 of the person who is changing the diaper. As seen in FIG. 3, straps 24 and 26 are wrapped around 80 of the user and the straps are attached in this position by means of Velcro® attachments 28 and 30. Baby 70 is then positioned on diaper 60, again as seen in FIG 3. User's hand 82 is used to support baby 70 and prevent him or her from squirming. Flaps 18, 20, and 22 can be unfolded and the diaper wrapped and secured around the baby. Once the diapering operation is completed, the user removes baby 70 with secured diaper 60 from diaper changing device 1 to a safe location. Straps 24 and 26 of diaper changing device 1 are removed from user's leg 80. Diaper changing device 1 then can be neatly and compactly folded and stored for later use.

Diaper changing device 1 permits a baby to be changed by a seated person, in a sanitary manner, regardless of the location. Use of the device is easy and safe. The device is lightweight and easily stored and thus very portable.

Certain novel features and components of this invention are disclosed in detail in order to make the invention clear in at least one form thereof However, it is to be clearly understood that the invention as disclosed is not necessarily limited to the exact form and details as disclosed, since it is apparent that various modifications and changes may be made without departing from the spirit of the invention.

The invention claimed is:

1. A portable diaper changing device comprising:

a baby supporting member having a diaper supporting surface;

flap means extending from the baby supporting member for securing a diaper to the diaper supporting surface of the baby supporting member; and means extending from the baby supporting member for attaching said baby supporting member to the leg of a user.

2. The portable diaper changing device as in claim 1 wherein the flap means comprising a rear flap and at least one forward flap.

3. The portable diaper changing device as in claim 1 wherein the means for attaching the baby supporting member to the leg of the user comprises at least one strap connected to the baby supporting member.

4. The portable diaper changing device as in claim 3 wherein the strap comprises means for securing the strap around the leg of the user.

5. The portable diaper changing device as in claim 1 further comprising means on the baby supporting surface to adhere the diaper to the baby supporting member.

6. The portable diaper changing device as in claim 1 further comprising means for maintaining the diaper between the flap means and the baby supporting member.

7. The portable diaper changing device as in claim 6 wherein the means for maintaining the diaper comprises magnets located in the flap means and in the baby supporting member.

8. The portable diaper changing device as in claim 5 further comprising means for maintaining the diaper between the flap means and the baby supporting member.

9. The portable diaper changing device as in claim 8 wherein the means for maintaining the diaper comprises magnets located in the flap means and in the baby supporting member.

10. The portable diaper changing device as in claim 1 wherein the baby supporting member comprises means for bendable adjustment of the configuration of the baby supporting member.

11. A portable diaper changing device comprising:

a baby supporting member having a forward section, an intermediate section, and a rear section;

first means extending from the rear section for securing a diaper to the baby supporting member;

second means extending from the forward section for securing a diaper to the baby supporting member; and means extending from the baby supporting member for attaching said baby supporting member to the leg of a user.

12. The portable diaper changing device as in claim 11 wherein the first means comprises a rear flap and the second means comprises at least one forward flap.

13. The portable diaper changing device as in claim 11 wherein the means for attaching the baby supporting member to the leg of the user comprises at least one strap connected to the baby supporting member.

14. The portable diaper changing device as in claim 13 wherein the strap comprises means for securing the strap around the leg of the user.

15. The portable diaper changing device as in claim 11 further comprising means on the baby supporting surface to adhere the diaper to the baby supporting member.

16. The portable diaper changing device as in claim 11 further comprising means for maintaining the diaper between the first means and the baby supporting member and the second means and the baby supporting member.

17. The portable diaper changing device as in claim 16 wherein the means for maintaining the diaper comprises magnets located in the first and second means and in the baby supporting member.

18. The portable diaper changing device as in claim 15 further comprising means for maintaining the diaper between the first means and the baby supporting member and the second means and the baby supporting member.

19. The portable diaper changing device as in claim 18 wherein the means for maintaining the diaper comprises magnets located in the e first and second means and in the baby supporting member.

20. The portable diaper changing device as in claim 11 wherein the baby supporting member comprises means for bendable adjustment of the configuration of the baby supporting member.

* * * * *